United States Patent [19]

Huston

[11] Patent Number: 4,983,954

[45] Date of Patent: Jan. 8, 1991

[54] SHOCK HAZARD WARNING DEVICE

[75] Inventor: Steven W. Huston, Agoura Hills, Calif.

[73] Assignee: Rockwell International Corporation, El Segundo, Calif.

[21] Appl. No.: 414,813

[22] Filed: Sep. 29, 1989

[51] Int. Cl.[5] ..... G08B 21/00

[52] U.S. Cl. ..... 340/657; 340/661; 324/457

[58] Field of Search ..... 340/657, 660, 661, 662; 324/457; 361/78

[56] References Cited

U.S. PATENT DOCUMENTS

| | | | |
|---|---|---|---|
| 3,309,690 | 3/1967 | Moffitt | 340/657 |
| 4,277,745 | 7/1981 | Deno | 324/457 X |
| 4,714,915 | 12/1987 | Hascal et al. | 340/657 |

*Primary Examiner*—Donald O. Wooden
*Assistant Examiner*—Jeffery A. Hofsass
*Attorney, Agent, or Firm*—H. Fredrick Hamann; Harry B. Field; Steven E. Kahm

[57] ABSTRACT

A warning device (10) is provided for use by electrical technicians or the like to indicate the presence of an electrical shock hazard. The warning device is adapted to be worn on the wrists or the like and includes a filtered detection circuit (32,34) for sensing a target signal such as an ac noise signal emitted from an electrical source. When the target signal magnitude exceeds a selected threshold (40), such as when the wearer moves into close proximity with the signal source, the warning device (10) activates an alarm (42,44) to indicate the presence of a shock hazard.

9 Claims, 1 Drawing Sheet

FIG. 1
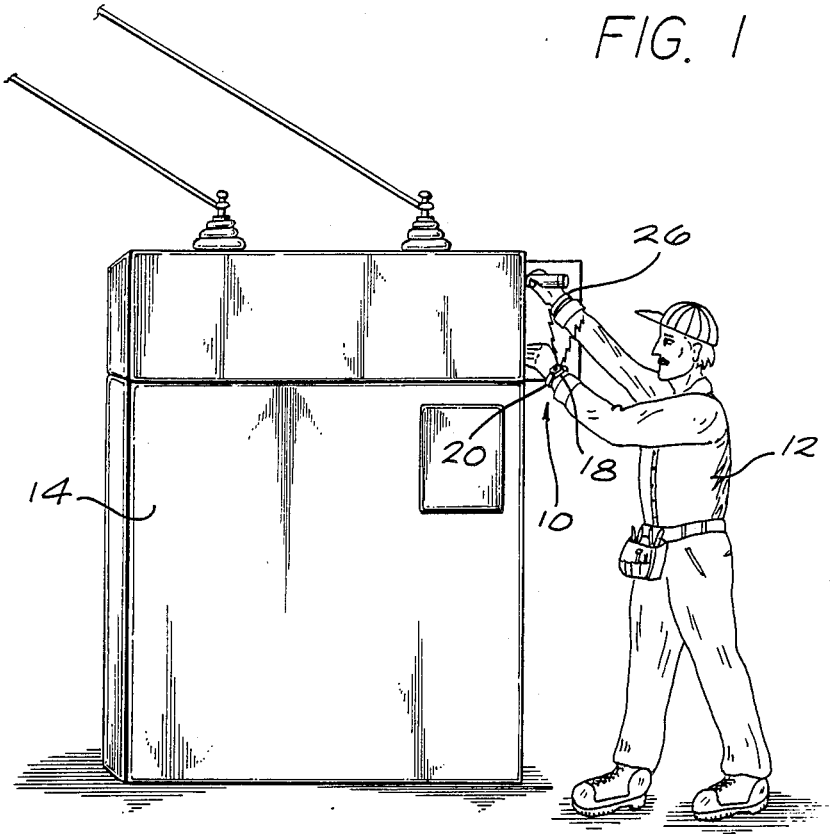
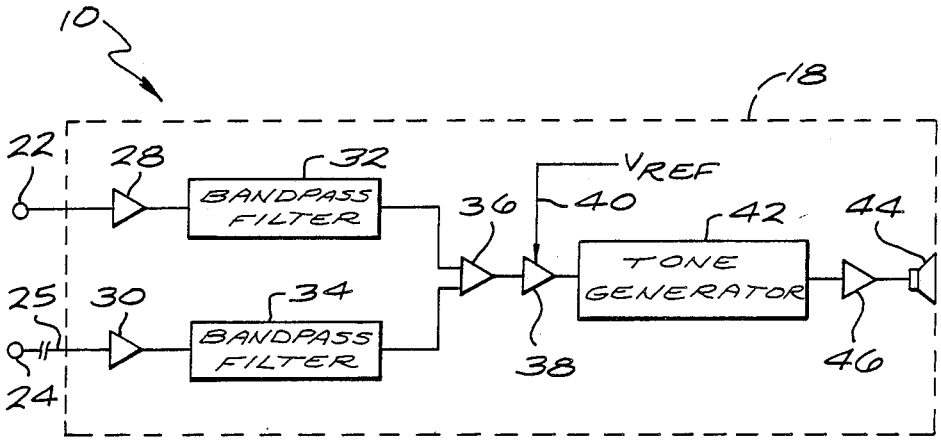
FIG. 2

SHOCK HAZARD WARNING DEVICE

BACKGROUND OF THE INVENTION

This invention relates generally to safety devices and related equipment systems for use by electrical technicians and/or other persons working on or in the vicinity of electrical equipment. More particularly, this invention relates to a relatively compact and simple warning device for activating an alarm upon detection of an electrical shock hazard.

Many people are required to work on or with electrical equipment which, if not properly safeguarded, presents a risk of severe injury or death as a result of electrical shock. For example, relatively high powered and/or high voltage equipment, such as electrical generators and transformers, etc., are widely used in many industrial or commercial endeavors, wherein the electrical equipment is normally contained within a protective enclosure or housing to prevent accidental contact therewith. Unfortunately, in the course of routine operation or maintenance, it is often necessary to open or remove portions of the protective housing to permit direct access to electrical components contained therein. In this regard, warning signs are commonly placed on or adjacent to the electrical equipment to remind personnel regarding potential shock hazard if the housing is opened, and further to remind personnel that access to the housing interior should be restricted to engineers, technicians, or other trained and/or authorized persons. Notwithstanding these safeguards, incidents of severe electrical shock occur with undesirable frequency, sometimes involving supposedly trained personnel as a result of individual negligence or faulty equipment.

There exists, therefore, a significant need for further improvements in safety devices and systems designed to reduce and/or eliminate incidents of severe electrical shock. The present invention fulfills this need by providing a relatively simple and compact warning device which can be carried or worn by selected individuals, and which functions to activate an alarm whenever the individual is in close proximity with electrical equipment presenting a shock hazard.

SUMMARY OF THE INVENTION

In accordance with the invention, a warning device is provided for detecting the presence of an electrical shock hazard, and for responding thereto to activate an alarm. The warning device is adapted as a lightweight and highly portable system which can be worn on the wrists of a technician or other person required to work on or with potentially hazardous electrical equipment. The warning device responds to electrical noise signals emitted from the electrical equipment to activate the alarm when the detected signals exceed a selected threshold representative of the wearer moving into close proximity with the signal source. When the alarm is activated, the wearer is alerted to the shock hazard and can take appropriate safety precautions, for example, by insuring electrical disconnection of the equipment before proceeding with an otherwise hazardous activity such as a repair or maintenance procedure.

In the preferred form, the warning device is adapted in a compact and portable form to be carried or worn by an individual, most preferably as a wrist or arm mounted device in the manner of a conventional wristwatch. The warning device includes a pair of electrodes mounted by wrist straps or the like respectively onto the wearer's left and right wrists, such that the electrodes are disposed in spaced relation to each other and at typically different distances from the signal source. As the wearer moves closer to the signal source, the electrodes function in combination with the person's body as an antenna to receive noise signals emitted by and radiated from the source at a signal magnitude which increases as the wearer moves into close proximity with the source.

The warning device includes a signal detection circuit having appropriate filters tuned to receive and detect target noise signals emitted from a target source or sources in the vicinity of the wearer. The detected target signal is compared with a threshold point representative of close source proximity and undesired shock hazard. When this threshold point is exceeded, an alarm such as an audio tone generator and associated speaker are activated to provide the desired shock hazard warning.

Other features and advantages of the invention will become more apparent in view of the following detailed description taken in conjunction with the accompanying drawings which illustrate, by way of example, the principles of the invention.

BRIEF DESCRIPTION OF THE DRAWINGS

The accompanying drawings illustrate the invention. In such drawings:

FIG. 1 a pictorial representation illustrating a technician in close proximity with electrical equipment, wherein the technician is wearing the warning device embodying the novel features of the present invention; and FIG. 2 is a block diagram illustrating the functional components of the warning device depicted in FIG. 1.

DETAILED DESCRIPTION OF THE PREFERRED EMBODIMENT

As shown in the exemplary drawings, a warning device referred to generally by the reference numeral 10 in FIG. 1 is provided for detecting and indicating the presence of an electrical shock hazard. The warning device 10 is particularly designed as a compact unit which can be worn unobtrusively by a technician 12 or other person required to work on or in the vicinity of potentially hazardous electrical equipment. The warning device 10 includes means for detecting the presence of a target electrical signal or signals, and for activating an alarm when the detected signal exceeds a selected threshold representative of an unacceptable shock hazard.

The shock hazard warning device 10 of the present invention provides an additional and effective safeguard to protect personnel against severe electrical shock which might otherwise occur as a result of faulty electrical equipment and/or improper use thereof. More particularly, with reference to FIG. 1, the device 10 is provided as a compact and portable system adapted to be worn on the wrists or arms of a technician 12 or the like especially in the course of any task involving direct access to electrical or electronic equipment contained within a normally closed protective housing 14. The warning device is tuned to detect signals emitted from the electrical equipment during normal operation thereof, such as an ac signal emitted at a known frequency from a typical electrical generator or transformer or the like. The detected signals normally increase significantly in magnitude as the warning device 10 is moved into close proximity with the signal source. When the signal magnitude exceeds a selected maximum, the alarm is activated to alert the wearer to take appropriate precautionary steps before proceeding with a particular task, such as a repair or maintenance procedure.

As shown in FIG. 1 in a preferred form, the warning device 10 includes a compact casing 18 adapted to be worn about one wrist or arm of a person using the invention. In this regard, the casing 18 includes a wrist strap 20 to permit removable mounting in the manner of a conventional wristwatch. The casing includes one electrode 22 as viewed in FIG. 2, and a second electrode 24 is adapted for convenient mounting onto the wearer at a separate location, such as on the other wrist by means of a strap 26 (FIG. 1). In this regard, the electrode 24 is coupled to the casing 18 by means of an appropriate conductor 25 (FIG. 2) which may be conveniently concealed within the technicians clothing. The electrodes 22 and 24 function in cooperation with the wearer's body to provide an antenna for receiving the target signals, as will be described in more detail.

The electrodes 22 and 24 are connected to a detection circuit tuned to receive the specific target signal or signals. More particularly, as viewed in FIG. 2, the electrodes 22 and 24 are connected respectively to a pair of buffer amplifiers 28 and 30. These buffer amplifiers are normally set for unity gain and function to isolate a corresponding pair of bandpass filters 32 and 34 from resistance variations or fluctuations inherent in the wearer's skin and body. The bandpass filters 32 and 34 have a construction generally well known to those persons skilled in the art and are designed for relatively sharp tuning response to receive and pass a relatively narrow frequency band range defining the target signal or signals radiated from the target equipment source.

The outputs of the two bandpass filters 32 and 34 are coupled as dual inputs to a common amplifier 36. In one preferred form, this amplifier 36 comprises a differential amplifier designed to provide an output signal representative of the difference between the output of the filters 32 and 34. In this regard, by mounting the two electrodes 22 and 24 on the wearer's opposite wrists, the electrodes are normally positioned at significantly different distances from the target source. As a result, the output of the differential amplifier 36 will normally increase significantly as the technician 12 approaches the target source, with stray or unwanted ambient noise being cancelled out. Alternately, if desired, the amplifier 36 may be a summing amplifier. In either case, the output of the amplifier 36 generally varies as an inverse function of electrode distance to the target source.

A voltage detector 38 receives the output of the amplifier 36 for comparison with a threshold reference signal 40 (FIG. 2). This threshold reference signal is chosen to represent a signal magnitude associated with an unacceptable shock hazard and close proximity to the target signal source. If desired, the threshold reference signal may be variably set by means of a conventional potentiometer control (not shown) exposed on the exterior of the unit casing An output or enabling signal is transmitted by the voltage detector 38 to an audio tone generator 42 whenever the output of the amplifier 36 exceeds the magnitude of the reference signal 40.

The tone generator 42 comprises a conventional oscillator or the like of the type used to drive an audio speaker 44. In this regard, the tone detector is activated by the enabling voltage detector signal which typically comprises a dc signal of programmed magnitude. The tone generator may be equipped with a timer or other programmable logic means to provide a timed or beeper type signal output from the speaker 44. An amplifier 46 is normally interposed between the tone generator 42 and the speaker 44 for impedance matching of the circuit components. Alternately, as desired, other types of alarms such as visual alarms may be used in lieu of and/or in addition to the audio alarm depicted FIG. 2.

In one working embodiment of the invention, the warning device 10 was provided in wrist mounted form as depicted in FIG. 1, with the casing 18 carrying an appropriate battery power supply for operating the circuit components. An on-off switch (not shown) was installed on the casing to permit user disablement, if desired. The bandpass filters 32 and 34 were designed for tuned response to a 20 kilohertz ac signal of the type radiated from a 20 kilohertz ac power supply and related electronic equipment as proposed for use in certain aerospace and/or outer space applications. The amplifier 36 comprised a differential amplifier for coupling a differential ac output signal at approximately 20 kilohertz to the voltage detector 38. This detected signal was found to increase significantly as the wearer of the device 10 approached the signal source, such that the reference signal 40 could be selected for alarm activation as the wearer moved within a few feet of the source equipment. Alarm activation was triggered when the detected signal applied to the voltage detector 38 exceeded the reference signal 40, thereby effectively alerting the wearer to the proximity of the signal source, and permitting de-energization of the source or other safety precautions before proceeding further with a service or repair task.

A variety of modifications and improvements to the warning device 10 of the present invention will be apparent to those skilled in the art. Accordingly, no limitation on the invention is intended by way of the foregoing description and the accompanying drawings except as set forth in the appended claims.

What is claimed is:

1. A shock hazard warning device for detecting and indicating the presence of electrical shock hazard in connection with electrical equipment, said device comprising:

detection means for detecting an electrical signal generated by the electrical equipment, said detection means including a pair of electrodes, means for mounting said electrodes onto a person's body, and means for combining signals detected by said electrodes to provide a composite detected signal;

comparison means for comparing said composite detected signal relative to a selected reference signal representing a selected threshold level representative of an unacceptable shock hazard; and alarm means activated by said comparison means when an unacceptable shock hazard is present.

2. The shock hazard warning device of claim 1 wherein said detection means includes filter means tuned for receiving and passing a selected target signal.

3. The shock hazard warning device of claim 1 wherein said mounting means comprises a pair of wrist straps.

4. The shock hazard warning device of claim 1 wherein said alarm means comprises an audio alarm.

5. The shock hazard warning device for indicating the presence of a shock hazard associated with electrical equipment, said device comprising:

a relatively compact casing including means for mounting onto a person's body at a selected location;

a first electrode carried by said casing;

a second electrode;

means for mounting said second electrode onto the person's body at a selected location spaced apart from said casing;

bandpass filter means coupled to said electrodes and tuned for receiving and passing selected target signals generated by the electrical equipment at a magnitude proportional to the distance of said electrodes from the electrical equipment;

means for combining the outputs of said bandpass filter means to provide a composite detected signal;

comparison means for comparing said composite detected signal with a selected reference signal representing an unacceptable shock hazard; and alarm means carried by said casing and activated by said comparison means for indicating when an unacceptable shock hazard is present.

6. The shock hazard warning device of claim 5 wherein bandpass filter means and said comparison means are carried by said casing.

7. The shock hazard warning device of claim 5 wherein said mounting means for said casing and for said second electrode respectively comprise a pair of wrist straps.

8. The shock hazard warning device of claim 5 wherein said alarm means comprises an audio alarm.

9. A method of indicating the presence of an unacceptable shock hazard associated with electrical equipment, said method comprising the steps of:

mounting a pair of electrodes onto a person's body in spaced relation to each other;

using the electrodes to detect target signals generating by the electrical equipment at a magnitude which is proportional to distances of the electrodes from the electrical equipment;

combining the signals detected by the electrodes to a selected reference signal having a magnitude representative of an unacceptable shock hazard; and activating an alarm when an unacceptable shock hazard is detected.

* * * * *

UNITED STATES PATENT AND TRADEMARK OFFICE

CERTIFICATE OF CORRECTION

PATENT NO. : 4,983,954
DATED : 01/08/91
INVENTOR(S) : Steven W. Huston

It is certified that error appears in the above-identified patent and that said Letters Patent is hereby corrected as shown below:

Column 6, Line 18-19:

Delete "generating" and insert --generated--

Column 6, Line 22:

after the word to insert --provide a composite detected signal; comparing the composite detected signal with--

Signed and Sealed this

Twenty-eighth Day of April, 1992

*Attest:*

HARRY F. MANBECK, JR.

*Attesting Officer*

*Commissioner of Patents and Trademarks*